United States Patent [19]

Secrist et al.

[11] Patent Number: 4,484,997

[45] Date of Patent: Nov. 27, 1984

[54] CORROSION-RESISTANT CERAMIC ELECTRODE FOR ELECTROLYTIC PROCESSES

[75] Inventors: Duane R. Secrist, Elizabethton; James M. Clark, Johnson City, both of Tenn.

[73] Assignee: Great Lakes Carbon Corporation, New York, N.Y.

[21] Appl. No.: 501,632

[22] Filed: Jun. 6, 1983

[51] Int. Cl.[3] ..... C25C 3/06; C25C 3/12

[52] U.S. Cl. ..... 204/243 R; 204/290 R; 264/61; 427/126.3

[58] Field of Search ..... 204/67, 291, 292, 290 R, 204/243 R; 264/61, 62; 427/126.3

[56] References Cited

U.S. PATENT DOCUMENTS

| | | | |
|---|---|---|---|
| 3,960,678 | 1/1976 | Alder | 204/245 |
| 4,233,148 | 11/1980 | Ramsey | 204/291 |
| 4,379,033 | 5/1983 | Clark | 204/67 |

*Primary Examiner*—John F. Niebling

*Attorney, Agent, or Firm*—R. Laddie Taylor

[57] ABSTRACT

A ceramic electrode suitable for use in an electrolytic cell has a conductive ceramic substrate of a base material and at least one additive material having a concentration greater than its solubility limit in the base material, and a coating of the base material on the substrate. The electrode is produced such that the additive material is diffused from the substrate to the coating, but such diffusion is terminated before or upon reaching the solubility limits of the additive material in the coating.

9 Claims, No Drawings

CORROSION-RESISTANT CERAMIC ELECTRODE FOR ELECTROLYTIC PROCESSES

BACKGROUND OF THE INVENTION

1. Field Of The Invention

The invention relates to improved ceramic electrodes and to a method for achieving improved corrosion resistance for such electrodes. The invention has specific application in the production of anodes for the electrowinning of aluminum in Hall-Heroult cells.

2. Description Of The Prior Art

Electrolysis cells, such as a Hall-Heroult cell for aluminum production by the electrolysis of alumina in molten cryolite, conventionally employ conductive carbon electrodes. During the reaction to manufacture aluminum metal, the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the use of carbon anodes are related to the cost of the anode consumed in the above reaction and to the impurities introduced to the melt from the carbon source. The petroleum cokes used in the fabrication of the anodes generally have significant quantities of impurities, principally sulfur, silicon, vanadium titanium, iron and nickel. Sulfur is oxidized to its oxides, causing troublesome workplace and environmental pollution problems. THe metals, particularly vanadium, are undesirable as contaminants in the aluminum metal produced. Removal of excess quantities of the impurities requires extra and costly steps when high purity aluminum is to be produced.

If no carbon were consumed in the reduction the overall reaction would be $2Al_2O_3 \rightarrow 4Al + 3O_2$ and the oxygen produced could theoretically be recovered. More importantly, with no carbon consumed at the anode there would be no contamination of the atmosphere or the product from the impurities present in the coke.

Attempts in the past to produce corrosion-resistant non-consumable electrodes for electrolytic processes such as aluminum production have met with little apparent success. Metal electrodes either melt at the temperature of operation, or corrode by chemical attack, e.g., by the cryolite bath in the case of a Hall-Heroult cell. Most ceramic compounds, such as oxides with perovskite and spinel crystal structures, usually have too high electrical resistance or are chemically attacked.

Previous efforts in the field are disclosed in U.S. Pat. No. 3,718,550—Klein, Feb. 27, 1973, Cl. 204/67; U.S. Pat. No. 4,039,401—Yamada et al., Aug. 2, 1977, Cl. 204/67; U.S. Pat. No. 2,467,144—Mochel, Apr. 12, 1949, Cl. 106/55; U.S. Pat. No. 2,490,825—Mochel, Feb. 1, 1946, Cl. 106/55; U.S. Pat. No. 4,098,669—de Nora et al., July 4, 1978, Cl. 204/252; Belyaev+-Studentsov, *Legkie Metal* 6, No. 3, 17-24 (1937), (C.A. 31 [1937], 8384) and Belyaev, *Legkie Metal* 7, No. 1, 7-20 (1938) (C.A. 32 [1938], 6553).

Of the above references, Klein discloses an anode of at least 80% $SnO_2$, with additions of $Fe_2O_3$, ZnO, $Cr_2O_3$, $Sb_2O_3$, $Bi_2O_3$, $V_2O_5$, $Ta_2O_5$, $Nb_2O_5$ or $WO_3$. Yamada discloses spinel structure oxides of the general formula $XYY'O_4$ and perovskite structure oxides of the general formula $RMO_3$, including the compounds $CoCr_2O_4$, $TiFe_2O_4$, $NiCr_2O_4$, $NiCo_2O_4$, $LaCrO_3$, and $LaNiO_3$. Mochel discloses $SnO_2$ plus oxides of Ni, Co, Fe, Mn, Cu, Ag, Au, Zn, As, Sb, Ta, Bi and U. Belyaev discloses anodes of $Fe_2O_3$, $SnO_2$, $Co_3O_4$, NiO, ZnO, CuO, $Cr_2O_3$ and mixtures thereof as ferrites. De Nora discloses $Y_2O_3$ with Y, Zr, Sn, Cr, Mo, Ta, W, Co, Ni, Pd, Ag, and oxides of Mn, Rh, Ir, and Ru.

The Mochel patents relate to electrodes for melting glass, while the remainder are intended for high temperature electrolysis, such as Hall-Heroult aluminum reduction. Problems with the materials above are related to the cost of the raw materials, the fragility of the electrodes, the difficulty of making a sufficiently large electrode for commercial usage, and the low electrical conductivity of many of the materials above when compared to carbon anodes.

U.S. Pat. No. 4,146,438, Mar. 27, 1979, de Nora et al., Cl. 204/1.5, discloses electrodes comprising a self-sustaining body or matrix of sintered powders of an oxycompound of at least one metal selected from the group consisting of titanium, tantalum, zirconium, vanadium, niobium, hafnium, aluminum, silicon, tin, chromium, molybdenum, tungsten, lead, manganese, beryllium, iron, cobalt, nickel, platinum, palladium, osmium, iridium, rhenium, technetium, rhodium, ruthenium, gold, silver, cadmium, copper, zinc, germanium, arsenic, antimony, bismuth, boron, scandium and metals of the lanthanide and actinide series and at least one electroconductive agent, the electrodes being provided over at least a portion of their surface with at least one electrocatalyst.

U.S. Pat. No. 3,930,967—Alder, Jan. 6, 1976, Cl. 204/67, discloses bi-polar electrodes made by sintering formed mixtures of $SnO_2$, as a principal component, with small percentages of $Sb_2O_3$, $Fe_2O_3$ and CuO.

U.S. Pat. No. 3,960,678—Alder, June 1, 1976, Cl. 204/67, discloses a Hall-Heroult process using an anode having a working surface of ceramic oxide, wherein a current density above a minimum value is maintained over the whole anode surface to prevent corrosion. The anode is principally $SnO_2$, preferably 80.0 to 99.7 wt. %. Additive oxides of Fe, Cu, Sb and other metals are disclosed.

U.S. Pat. No. 4,057,480—Alder, Nov. 8, 1977, Cl. 204/290 R, a divisional application from U.S. Pat. No. 3,960,678, relates to a ceramic oxide anode for a Hall-Heroult cell using a current density maintained above a minimum value over the contact surface of the anode. A protective ring is fitted over the three phase zone at the air-electrolyte-anode junction. Anode base material of $SnO_2$, 80.0-99.7 wt. % is shown with additions of 0.05-2.0 wt. % of oxides of Fe, Cu, Sb and other metals as dopants.

U.S. Pat. No. 4,233,148—Ramsey et al., Nov. 11, 1980, Cl. 204/291, discloses electrodes suitable for use in Hall-Heroult cells composed of $SnO_2$ with various amounts of conductive agents and sintering promoters, principally $GeO_2$, $Co_3O_4$, $Bi_2O_3$, $Sb_2O_3$, $MnO_2$, CuO, $Pr_2O_3$, $In_2O_3$ and $MoO_3$.

U.S. Pat. No. 4,379,033—Clark et al., Apr. 5, 1983, Cl. 204/67, relates to a method of producing aluminum in a Hall-Heroult cell employing a non-consumable anode having a substantially flat working surface produced by a process wherein a portion of a conductive core that is exposed to the electrolyte bath is coated with a composition of higher resistivity than the core composition to provide uniform current density at all regions of the working surface of the anode. The core preferably consists of $SnO_2$ doped with CuO and $Sb_2O_3$ and the coating preferably consists of an $Fe_2O_3$ doped $SnO_2$ composition.

U.S. Pat. No. 4,374,050—Ray, Feb. 15, 1983, Cl. 252/519, discloses an electrode composition fabricated from at least two metals or metal compounds combined to provide a combination metal compound containing at least one of the group consisting of oxide, fluoride, nitride, sulfide, carbide or boride, the combination metal compound defined by the formula:

$$\left\{\sum_{i=1}^{m}(M_i)F_{Mi}\right\}\left\{\sum_{j=1}^{p}(M_j)F_{Mj}\sum_{i=1}^{m}(M_i)F_{Mi}\right\}_Z\left(\sum_{r=1}^{n}X_rF_{xr}\right)_K$$

where $\sum_{i=1}^{m}F_{Mi}=1$; $\sum_{j=1}^{p}F_{Mj}+\sum_{i=1}^{m}F_{Mi}=1$ and $\sum_{r=1}^{n}X_rF_{xr}=1$;

Z is a number in the range of 1.0 to 2.2; K is a number in the range of 2.0 to 4.4; $M_j$ is at least one metal having a valence of 1, 2, 3, 4 or 5 and is the same metal or metals when $M_i$ is used in the composition; $M_j$ is a metal having a valence of 2, 3 or 4; $X_r$ is at least one of the elements from the group consisting of O, F, N, S, C and B; m, p and n are the number components which comprise $M_i$, $M_j$ and $X_r$; $F_{Mi}$, $F'_{Mj}$, $F'_{Mi}$ or $F_{xr}$ are the mole fractions of $M_i$, $M_j$ and $X_r$ and $0<\Sigma F'_{Mi}<1$.

U.S. Pat. No. 4,374,761—Ray, Feb. 22, 1983, Cl. 252/519 relates to an inert electrode composition suitable for use in the electrolytic production of metal from a metal compound dissolved in a molten salt comprised of a ceramic oxide composition amd at least one metal powder dispersed through the ceramic oxide composition for purposes of increasing its conductivity, the metal powder being selected from the group consisting of Ni, Cu, Co, Pt, Rh, In and Ir.

Despite the efforts described above, preparation of corrosion-resistant electrodes, particularly for use in Hall-Heroult cells, still has not been fully realized and no instance is known of any plant scale commercial usage. The spinel and perovskite crystal structures have in general displayed poor resistance to molten salt baths, disintegrating in a relatively short time.

Certain cermet compositions containing spinel phases show promise as corrosion-resistant electrodes, but the materials developed to date still do not possess the necessary anode properties.

Electrodes consisting of metals coated with ceramics using conventional methods have also shown poor performance, in that almost inevitably, even the smallest crack leads to chemical attack on the metal substrate, resulting in spalling of the coating and consequent destruction of the electrode. Of the materials cited above, $SnO_2$-based compositions with corrosion rates of less than one inch/year probably come closest to satisfying the criterion for dimensional stability. However, tin is an objectionable impurity in many aluminum alloys.

It is well established that the corrosion resistance of an electrode is influenced by its microstructure, i.e., the composition of the grain, grain size, and the presence of different phases in the grain boundaries. A single phase material is desirable to ensure uniform corrosion of an electrode. Additives are frequently required with electrode materials to improve electrical conductivity or sintering characteristics. For ceramic systems wherein mixing is conventionally done by wet milling, the inability to attain good dispersion for small additions, e.g., 0.1 wt. %, generally requires that larger amounts of material be added to meet minimum levels. For this procedure, precipitation of an additive-rich composition is frequently observed in the grain boundaries of a parent material when the amount of additive in a system exceeds the limits of solid solubility at sintering temperature. The second phase regions are undesirable in that selective corrosion can occur in these areas and decrease overall electrode performance and life.

SUMMARY OF THE INVENTION

We have now discovered a method to eliminate or minimize second phases in the grain boundaries of a ceramic electrode for electrolytic cells, particularly, but not exclusively, for use in a Hall-Heroult cell, comprising: (a) forming a conductive ceramic substrate comprising a base material and at least one additive material capable of diffusion within the base material; (b) applying a coating of the base material to the substrate; and (c) heat-treating the coated substrate under controlled conditions of temperature, pressure, time and atmosphere to diffuse the additive material from the substrate to the coating, wherein the diffusion is terminated before or upon reaching the solubility limits of the additive material in the coating.

The electrode resulting from this process also forms part of our invention.

DESCRIPTION OF THE PREFERRED EMBODIMENT

The following examples will further describe the invention. It is understood that these examples are provided to illustrate the practice of the invention and are not intended as limiting beyond the limitations imposed by the appended claims.

The electrodes characterized in the examples are Cu/Sb doped $SnO_2$ anodes fabricated for use in the Hall-Heroult process for making aluminum.

EXAMPLE 1

Electrode compositions of (a) 96 wt. % $SnO_2$, 2 wt. % CuO, and 2 wt. % $Sb_2O_3$ and (b) 98 wt. % $SnO_2$, 1 wt. % CuO, and 1 wt. % $Sb_2O_3$ were prepared by conventional wet milling of reagent grade oxide components in water. After drying, the powder compositions were calcined at 925° C. in air. Anodes 1" dia.×2" long were formed by isostatic molding at 20 Kpsi and sintered at 1400° C. for 4 hours in oxygen. The density of these samples was >96% based on a theoretical density of 6.95 gm/cm$^3$. Sections were sliced from one end of the anodes and polished for examination by electron microscopy. Second phase regions were conspicuous within the grain boundaries for the sample containing 96 wt. % $SnO_2$, 2 wt. % CuO, and 2 wt. % $Sb_2O_3$. For the sample containing 98 wt. % $SnO_2$, 1 wt. % CuO, and 1 wt. % $Sb_2O_3$ the second phase regions were markedly less frequent and better distributed within the grain boundaries. Microprobe analysis revealed that the second phase regions contained large amounts of copper, and that the Sb was uniformly distributed within the grains. Analysis within the grains indicated that the solid solubilities of Sb and Cu in $SnO_2$ are at least 1.0 wt. % and below 0.1 wt. %, respectively.

The anodes were suspended in a Hall-Heroult melt using Pt wires as current lead supports and electrolyzed at 960° C. for 23.85 hours (composition a) and 20.35 hours (composition b). The molten salt composition contained 81% cryolite, 5% $AlF_3$, 7% $CaF_2$, and 7% $Al_2O_3$ by weight. Following electrolysis, the excess bath residue was removed from the anodes.

Excessive pitting was observed on the electrolysis surfaces for the anode containing the larger amounts of second phase (96 wt. % $SnO_2$, 2 wt. % CuO, 2 wt. % $Sb_2O_3$) whereas the surfaces of the anode containing less second phase were uniformly smooth (98 wt. % $SnO_2$, 1 wt. % CuO, 1 wt. % $Sb_2O_3$). This experiment demonstrates that the amount of second phase is an important factor in determining the corrosion resistance of $SnO_2$-based electrodes for use in the Hall-Heroult production of aluminum.

EXAMPLE 2

A number of methods for applying a $SnO_2$ coating over a Cu/Sb doped $SnO_2$ substrate are available. One method which produces especially good results is chemical vapor deposition. A 0.6 mm thick coating was applied to a $SnO_2$-based substrate at 750° C. using $SnCl_4$ as the source chemical. The $SnO_2$ coating was impervious and remained adherent after cycling to 1000° C. in air. This method of coating is attractive for the invention for relatively thin coatings.

EXAMPLE 3

Isostatic pressing provides a means for applying thick coatings to a substrate. A substrate of 98.5 wt. % $SnO_2$, 0.5 wt. % CuO and 1 wt. % $Sb_2O_3$ was isostatically molded at 18 Kpsi using calcined powders. The molded sample was then surrounded with $SnO_2$ powder free from CuO and $Sb_2O_3$ and repressed at 20 Kpsi. The as-molded composite was sintered as in Example 1 to yield a monolithic sample with <98% theoretical density. The thickness of the coating was ~2 mm. A section of this sample was polished and examined via electron microscopy. Microprobe analysis revealed that Cu and Sb had diffused into the coated region. The concentration of Cu was observed to decrease rapidly from the original coating interface outward, whereas the Sb was relatively uniform. This behavior is expected for the diffusion of Cu and Sb wherein the solid solubility of Cu in $SnO_2$ is extremely low and the solid solubility of Sb in $SnO_2$ has not been exceeded.

In an alternative process, pure $SnO_2$ powder can be hot isostatically pressed onto a sintered Cu/Sb doped $SnO_2$ substrate. In this case, the substrate serves as a mandrel and diffusion of the Cu and Sb occurs during the coating densification process at high temperature and pressure.

It is apparent from the experiments that a ceramic electrode can be prepared with improved corrosion resistance by limiting the amount of second phase present in the grain boundaries of the electrode microstructure. This objective is accomplished by the invention.

While the invention has been described in detail and with reference to a specific embodiment thereof, it will be apparent to one skilled in the art that various changes and modification can be made therein without departing from the scope and spirit thereof, and, therefore, the invention is not intended to be limited except as indicated in the appended claims.

We claim:

1. A process for producing a ceramic electrode suitable for use in an electrolytic cell comprising:

(a) forming a conductive ceramic substrate comprising a base material and at least one additive material capable of diffusion within said base material;

(b) applying a coating of said base material to said substrate; and (c) heat-treating the coated substrate under controlled conditions of temperature, pressure, time and atmosphere to diffuse said additive material from said substrate to said coating, wherein the diffusion is terminated before or upon reaching the solubility limits of the additive material in the coating.

2. The process of claim 1 wherein the base material consists of $SnO_2$.

3. The process of claim 2 wherein the substrate consists of $SnO_2$, CuO and $Sb_2O_3$.

4. A process for producing a ceramic anode for a Hall-Heroult cell comprising:

(a) forming a conductive ceramic substrate comprising 98 wt. % $SnO_2$, 1 wt. % CuO and 1 wt. % $Sb_2O_3$;

(b) applying a coating of $SnO_2$ to said substrate; and (c) heat-treating the coated substrate under controlled conditions of temperature, pressure, time and atmosphere to diffuse the Cu and Sb from said substrate to said coating, wherein the diffusion is terminated before or upon reaching the solubility limits of the CuO and $Sb_2O_3$ in the $SnO_2$ coating.

5. A ceramic electrode suitable for use in an electrolytic cell comprising:

(a) a conductive ceramic substrate comprising a base material and at least one additive material having a concentration greater than its solubility limit in said base material and capable of diffusion therethrough; and (b) a coating of said base material on said substrate; wherein said additive is diffused throughout said electrode, the concentration of said additive in said coating not exceeding the solubility limit of said additive material in said coating.

6. The electrode of claim 5 wherein the coating consists of $SnO_2$.

7. The electrode of claim 6 wherein the substrate consists of $SnO_2$, CuO and $Sb_2O_3$.

8. A ceramic anode for a Hall-Heroult cell comprising:

(a) a conductive ceramic substrate comprising 98 wt. % $SnO_2$, 1 wt. % CuO and 1 wt. % $Sb_2O_3$ and (b) a coating of $SnO_2$ on said substrate; wherein the Cu and Sb are diffused throughout said electrode, the concentration of said CuO and $Sb_2O_3$ in said coating not exceeding the solubility limit of said CuO and $Sb_2O_3$ material in said coating.

9. A method for manufacturing aluminum in a Hall-Heroult cell employing a ceramic anode comprising:

(a) a conductive ceramic substrate comprising 98 wt. % $SnO_2$, 1 wt. % CuO and 1 wt. % $Sb_2O_3$ and (b) a coating of $SnO_2$ on said substrate; wherein the Cu and Sb are diffused throughout said electrode, the concentration of said CuO and $Sb_2O_3$ in said coating not exceeding the solubility limit of said CuO and $Sb_2O_3$ material in said coating.

* * * * *